US005185983A

United States Patent [19]

Slater

[11] Patent Number: 5,185,983

[45] Date of Patent: Feb. 16, 1993

[54] WAFER SEALER

[76] Inventor: John W. Slater, 4679 N. Ironwood La., Milwaukee, Wis. 53209

[21] Appl. No.: 844,532

[22] Filed: Mar. 2, 1992

[51] Int. Cl.[5] ..... B65B 51/06

[52] U.S. Cl. ..... 53/136.3; 53/136.1; 53/586; 156/483

[58] Field of Search ..... 53/415, 399, 466, 136.1, 53/136.3, 206, 580, 586; 156/483

[56] References Cited

U.S. PATENT DOCUMENTS 1,391,174 9/1921 De Escobales ..... 53/136.3
2,346,142 4/1944 Anderson ..... 156/483 X
3,535,189 10/1970 Hall ..... 53/586 X
5,084,127 1/1992 Nakamura ..... 53/586 X

*Primary Examiner*—John Sipos

[57] ABSTRACT

The machine of the invention comprises a pair of rolls on powered shafts with the ends of the rolls being fixed to the shafts and the central portions of the rolls floating on the shafts. When a mailing form piece and a wafer seal are moved in between the rolls, the powered roll ends engage only the form and pull it through the floating sleeves which sleeves are stopped from rotating when engaged by the seal to retard the movement of the seal and form a tight fit between the seal and the form.

1 Claim, 4 Drawing Sheets 1
2
3
4
5
6
9
10
11
12
13
14

WAFER SEALER

BACKGROUND

The U.S. Postal Service has recently enacted rules specifying how the open edges of brochures, folded cards and self-mailers are to be glued or sealed with wafer seals. It is necessary to glue or seal these types of mailings so that they will not jam automatic mail sorting machines now being installed by the U.S. Postal Service.

SUMMARY

The machine of this invention comprises an electro-mechanical system which will move a single mailing piece from a stack of mailing pieces into a transport system. While in the transport system the mailing piece has a wafer seal folded around the open lead edge, closing the lead edge of the mailing piece. Henceforth the mailing piece will be called a form.

DETAILED DESCRIPTION OF THE PREFERRED EMBODIMENT

Figure 1:
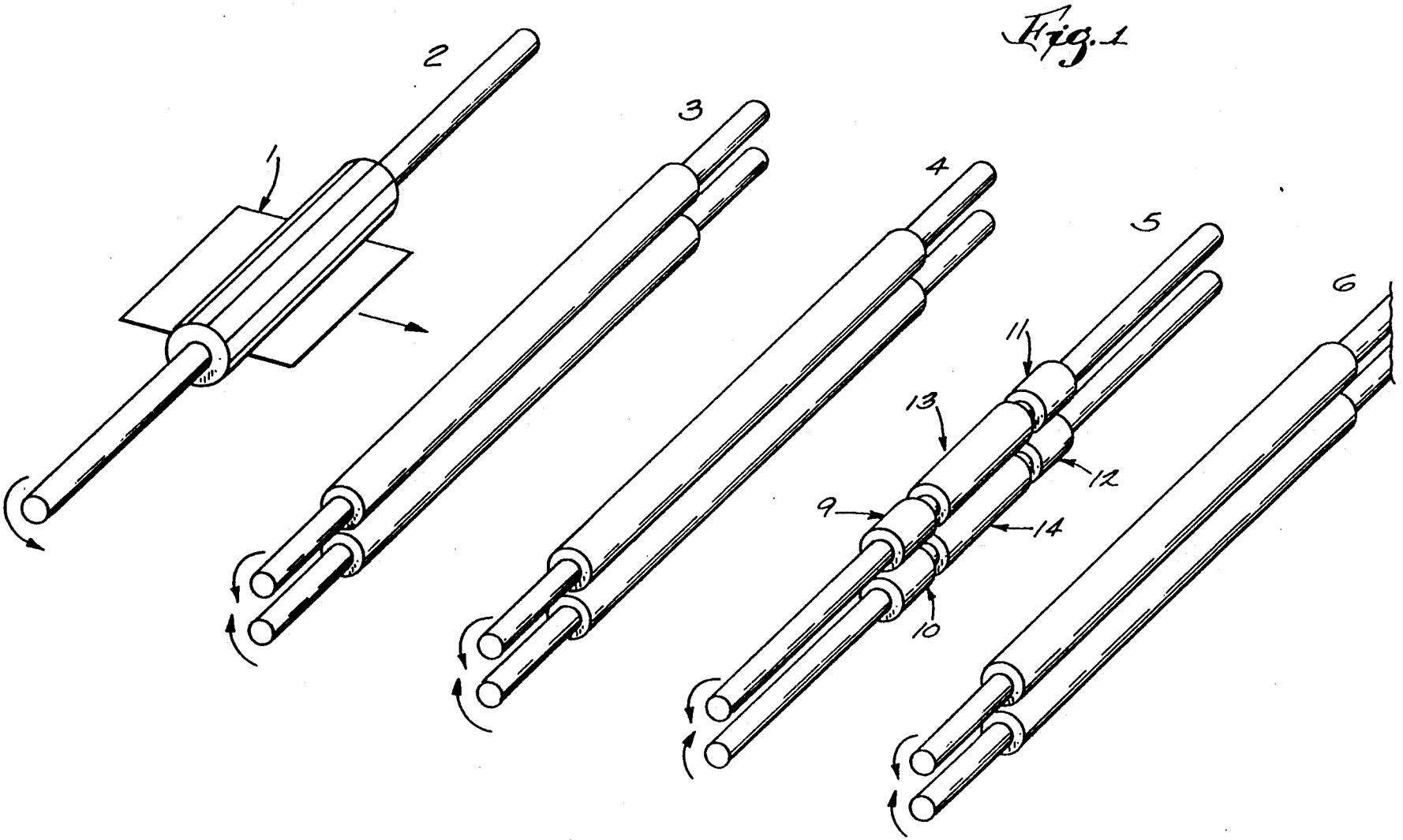
FIG. 1 is a partial perspective view of the form feed wheel with a form being fed into the transport system. The wafer folding mechanism is also shown.
Figure 2:
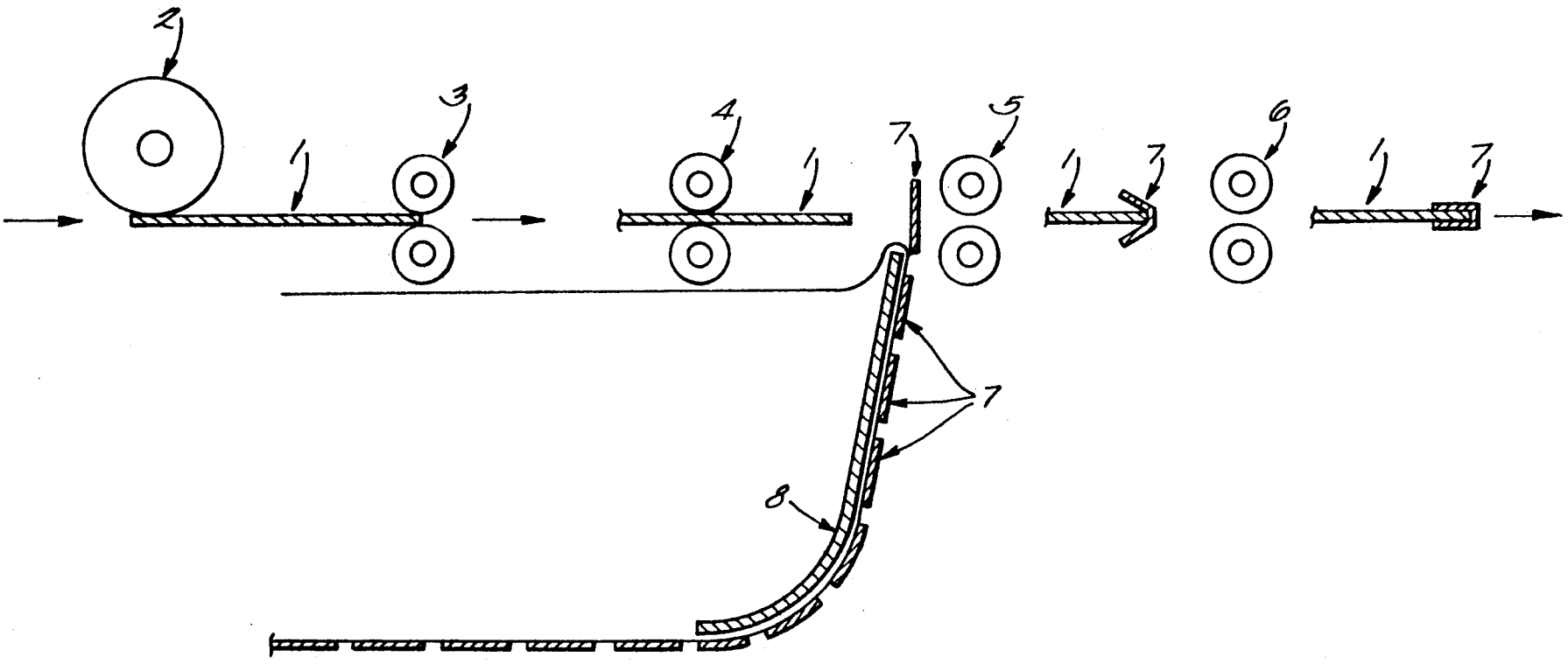
FIG. 2 is a fragmentary side view of the form feed wheel feeding a form into the form transport system. The form is advancing toward the peel plate where a pressure sensitive wafer seal is waiting for the form. The form and the wafer seal enter the first stage folding process where the wafer seal is partially folded around the lead edge of the form. The form with a partially folded wafer seal exits the first stage and enters the final stage of folding where the wafer seal is completely folded around the lead edge of the form.

FIG. 2 A form 1 is fed into the powered form rolls at station 3 of the form transport by the rotating feed roll 2. The form transport is comprised of powered rolls at stations 3, 4, 5 and 6. The powered form rolls of station 3 advance the form 1 to the powered form rolls at station 4. As form 1 is advanced through the powered form rolls at station 4 to station 5, a wafer seal 7 is positioned in the path of form 1 by electro-mechanical means via the peel plate 8. The first stage of wafer seal folding occurs at station 5.

Figure 3:
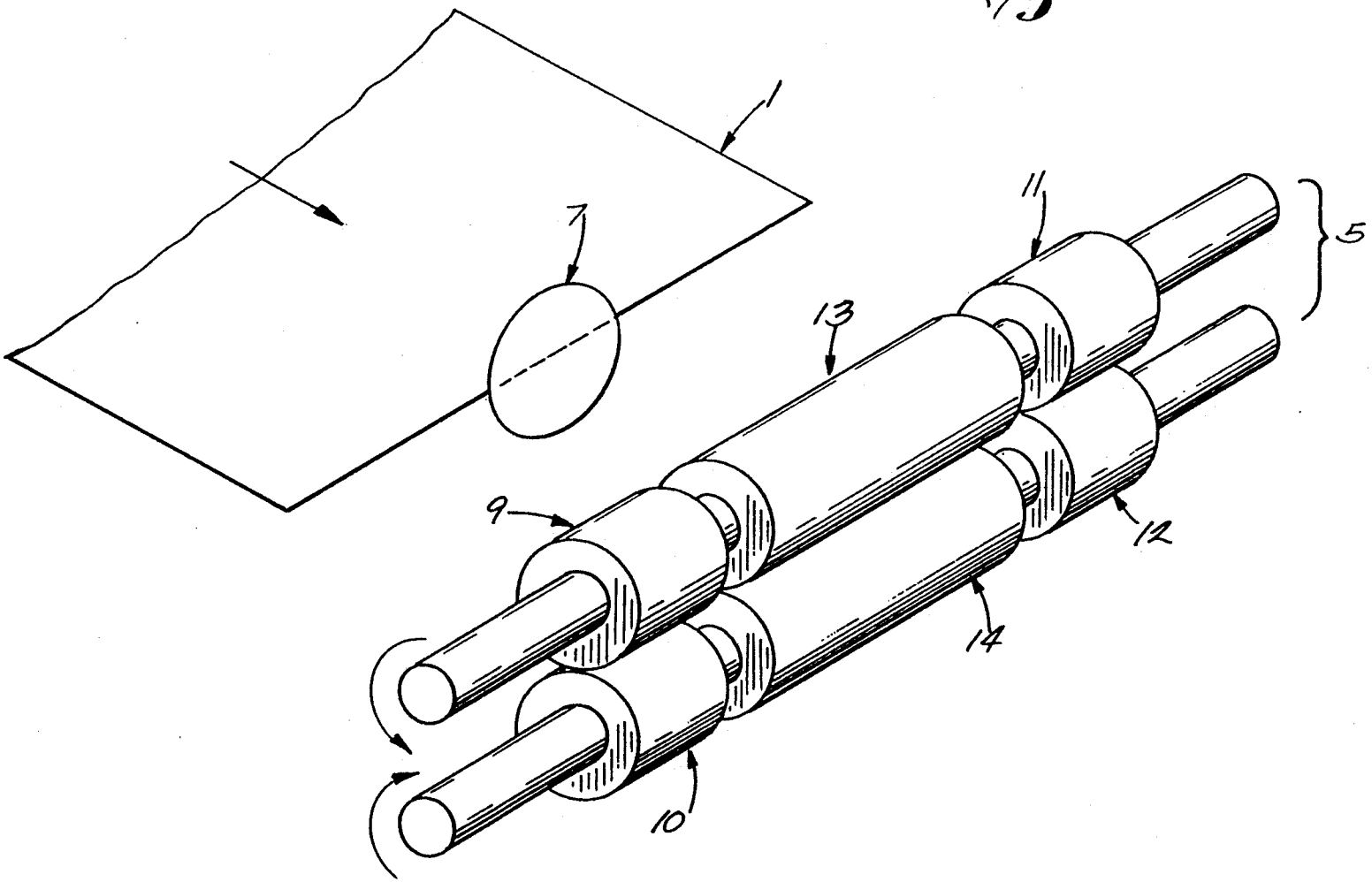
FIG. 3 is a partial perspective view of the first stage folding assembly.

FIG. 3 The form 1 and the wafer seal 7 move into station 5. The station 5 includes four form driving rolls 9, 10, 11 and 12 which are secured to powered shafts by set screws. Seal engaging sleeves 13 and 14 are floatingly mounted on the powered shafts and are not secured to the shafts or to the four form driving rolls. An external pressure exerted on the sleeves will cause the sleeves to stop. At the station 5 the wafer seal 7 and the form 1 enter the space between the non-powered floating sleeves 13 and 14. As the powered form rolls 9, 10, 11 and 12 draw form 1 and the wafer seal 7 through the non-powered floating sleeves 13 and 14, the pressure of the wafer seal 7 stops the non-powered sleeves 13 and 14. The stopping of the non-powered sleeves 13 and 14 by the wafer seal 7 causes wafer seal 7 to start folding tightly around the open edge of form 1.

FIG. 3 Form 1 and the partially folded wafer seal 7 are advanced to station 6. At station 6 the powered form rolls finish folding the wafer seal 7 around the edge of form 1.

Figure 5:
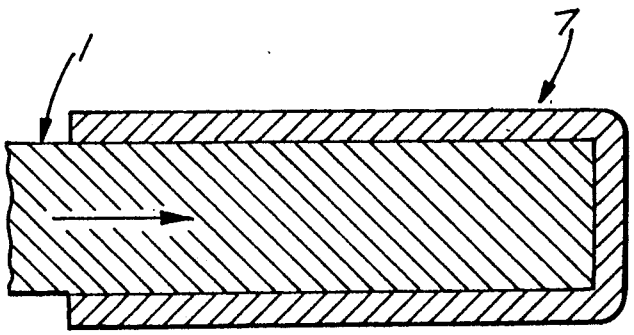
FIG. 5 shows a wafer seal folded around the lead edge of the form. There is no gap between the lead edge of the form and the inside edge of the wafer seal.
Figure 4:
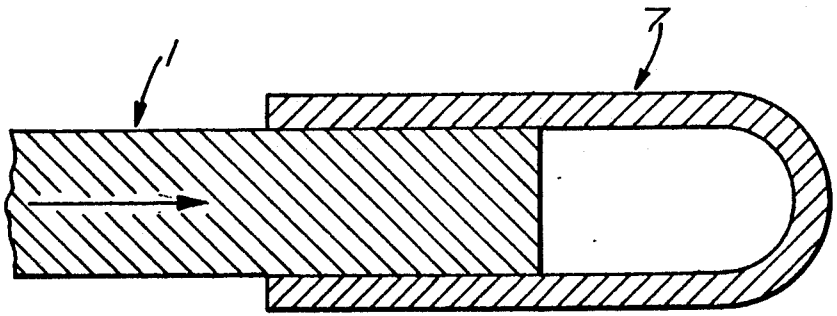
FIG. 4 shows a wafer seal folded around the lead edge of the form. There is a gap between the lead edge of the form and the inside surface of the wafer seal.

At station 5 the form and the wafer seal go into and through the space between the non-powered sleeves. Were it the case that there were no sleeves, just powered rolls such as stations 3, 4 and 6, the wafer seal would accelerate slightly ahead of the form as shown in FIG. 4, causing a gap between the lead edge of the form and the inside surface of the wafer seal. The function of the non-powered floating sleeves is to stop when the form pushes the wafer seal through the small space between the non-powered sleeves. The sleeves being stopped by the wafer seal retards the wafer seal speed with respect to the form speed, forcing a tight fit between the leading edge of the form and the inside surface of the wafer seal as in FIG. 5.

What is claimed:

1. An apparatus for applying a seal to the leading edge of a mailing form comprising, means for moving a form along a horizontal path, means for moving a seal narrower than said form across said path, means for moving said form into said seal and means for folding said seal on the leading edge of said form, said folding means comprising a shaft above and a shaft below said path extending across said path, non-powered sleeves floatingly mounted on said shafts for engaging said seal which sleeves are axially shorter than said form and longer than said seal, a pair of end rolls fixedly secured to each shaft on opposing axial end of said sleeves, means for driving said shafts and said rolls to engage only said form and pull it through said floating sleeves which sleeves are stopped from rotating when engaged by the seal to retard the movement of the seal and form a tight fit between the seal and the form.

* * * * *